United States Patent [19]

Hettinger, Jr.

[11] Patent Number: 4,470,460

[45] Date of Patent: Sep. 11, 1984

[54] IN SITU RETORTING OR OIL SHALE

[75] Inventor: William P. Hettinger, Jr., Russell, Ky.

[73] Assignee: Ashland Oil, Inc., Ashland, Ky.

[21] Appl. No.: 444,656

[22] Filed: Nov. 26, 1982

[51] Int. Cl.[3] ..... E21B 43/247

[52] U.S. Cl. ..... 166/260; 166/259; 166/261

[58] Field of Search ..... 166/259, 256, 260, 261; 299/2,11; 208/11

[56] References Cited

U.S. PATENT DOCUMENTS

| | | | |
|---|---|---|---|
| 3,001,776 | 9/1961 | van Poollen | 299/2 |
| 3,072,187 | 1/1963 | Carr | 166/257 X |
| 3,127,935 | 4/1964 | Poettmann et al. | 166/260 |
| 3,180,412 | 4/1965 | Bednarski et al. | 166/260 |
| 3,233,668 | 2/1966 | Hamilton et al. | 166/259 |
| 4,057,107 | 11/1977 | Pusch et al. | 166/260 |
| 4,086,960 | 5/1978 | Haynes | 166/260 X |
| 4,105,251 | 8/1978 | Wolff | 166/260 X |
| 4,193,454 | 3/1980 | Goldstein | 166/260 X |

*Primary Examiner*—Stephen J. Novosad
*Attorney, Agent, or Firm*—Richard C. Willson, Jr.; Charles A. McCrae

[57] ABSTRACT

An improved method of in situ retorting of oil shale wherein a cavern of crushed shale is created within an oil shale deposit, preferably by igniting a powerful explosion within the oil shale deposit, thereby creating a localized area or cavern of rubblized oil shale. Combustion gases are injected into the bottom of this cavern and particulate material, preferably a cracking catalyst, is deposited into a void at the top of the cavern and allowed to trickle down and fill the voids in the rubblized cavern. The oil shale is ignited at the bottom of the cavern and a combustion zone proceeds upwardly while the particulate material is caused by gas flow to percolate downwardly. A fluidized bed of particulate material is thereby formed at the combustion zone providing a controlled, evenly advancing combustion zone. This, in turn, efficiently retorts oil shale, provides increased recovery of hydrocarbon while simultaneously producing a catalytically cracked volatile, high octane gasoline exiting from the top of the retort.

9 Claims, 1 Drawing Figure

IN SITU RETORTING OR OIL SHALE

BACKGROUND OF THE INVENTION

The present invention relates to a method of in situ retorting of oil shale. The invention further relates to the in situ retorting of oil shale using a particulate material, preferably a cracking catalyst, in combination with a gaseous flow of oxidizing material.

Explosives are normally utilized to rubbilize the shale. Pillars and open chambers are coated and then dynamited to form a rubberized chamber of shale rock. This cavern is surrounded by a thick zone of fractured, but nevertheless impervious, shale or rock. The fractured rock, collapses so as to at least partially fill the cavity. Thus, a substantially cylindrical retort zone or chimney filled with crumbled oil shale results. This also leaves an empty area or void at the uppermost portion of the chimney. Such techniques are described, for example, in U.S. Pat. No. 3,342,257, issued Sept. 19, 1967 to Jacobs et al, and in U.S. Pat. No. 3,113,620, issued May 2, 1978 to Hemminger.

There are several problems encountered with this method of in situ retorting of oil shale. The combustion zone or area is continuously advancing through the chimney. In order to efficiently retort most of the oil within the chimney, however, the combustion zone must advance uniformly through the chimney at a relatively slow rate. If the combustion zone moves too quickly, channeling will tend to occur. Channeling is the movement of the retort gases along a channel as opposed to moving uniformly through the shale. If the combustion zone moves erratically, various parts of the chimney will not be retorted and the oil contained in these portions will be lost.

One of the causes of channeling and erratic movement of the combustion zone is improper rubblization in localized areas. If the rocks or shale are not properly rubblized, or are not broken into small enough fragments, the retort reaction will tend to occur on the surface of the shale and will not penetrate rock fragments and draw out the oil within the inner portion of an oil shale rock. It is extremely difficult to provide uniform rubblization. The erratic stratification of the shale formations, as well as various other factors, also prevents more uniform rubblization.

Even when the combustion zone moves at a desired rate, the produced oil tends to be of a low grade, high molecular weight oil requiring substantial additional processing. The produced oil tends to be high in nitrogen, sulfur, and arsenic, which must be removed.

Accordingly, it is an object of the present invention to improve the efficiency of in situ oil shale conversion, to provide a higher percentage of recovery of the oil, and to produce liquid products of a higher grade than ordinarily produced, with lower levels of impurities.

Furthermore, it is an object of the present invention to provide a method to overcome channeling and provide for substantially complete retorting of the oil shale within a chimney.

SUMMARY OF THE INVENTION

These and other objects are accomplished by first filling the entire cavern with a fine, particulate material and providing means at the upper portion of the chimney to remove the processed hydrocarbons. Oxygen-containing gas is then injected at the lower portion of the cavern and combustion is initiated at this lower portion. This causes the combustion zone to move upwardly while the particulate material tends to be fluidized in the entire combustion zone. Eventually, the particulate material forms a fluidized bed in the combustion zone which, in turn, causes the combustion zone to advance at a uniform rate throughout the chimney.

BRIEF DESCRIPTION OF THE DRAWINGS

FIG. I is a side elevational view partially in cross section showing the relative positions of an injection well and a production well, as an illustrative embodiment of the present invention.

DETAILED DESCRIPTION OF A PREFERRED EMBODIMENT

Figure 1:
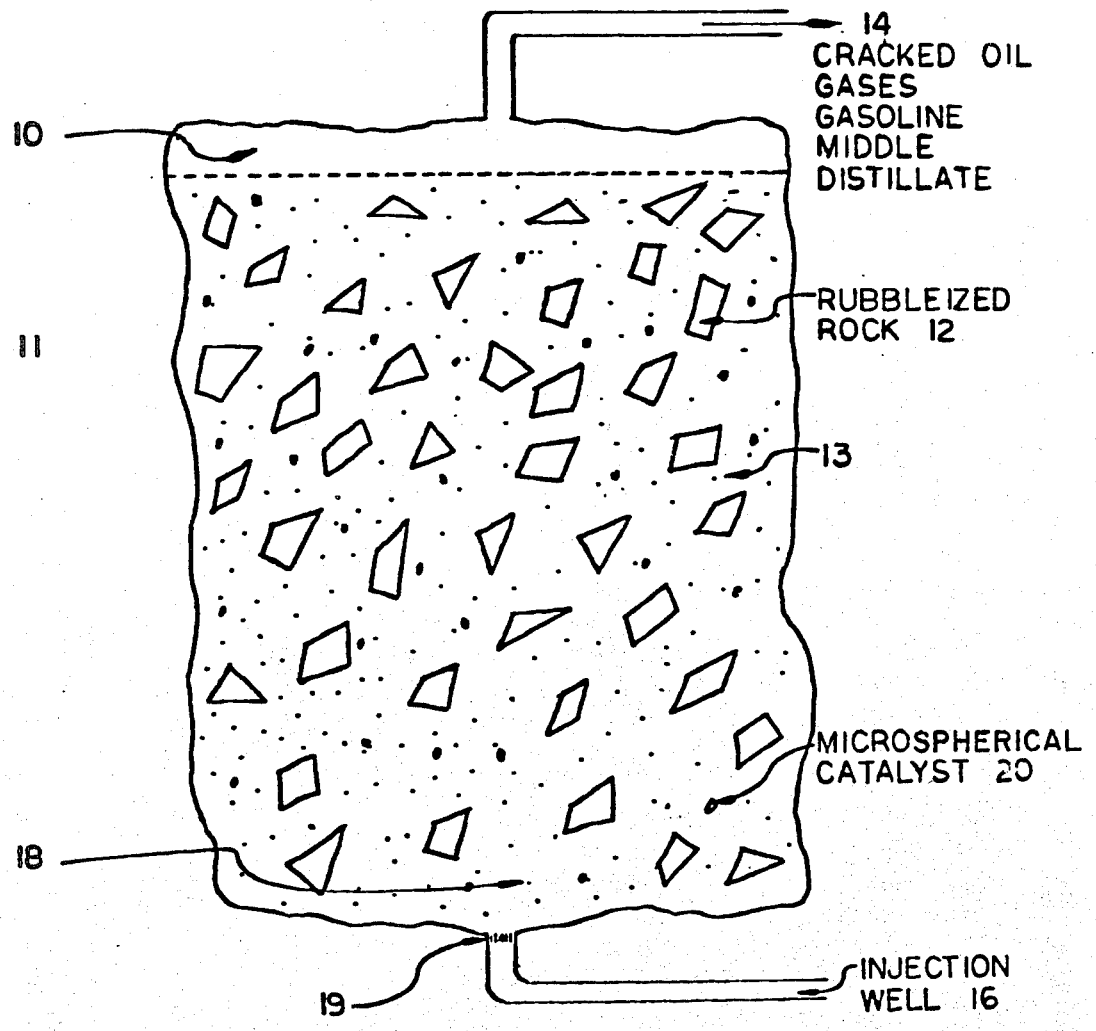

Producing Rubblized Oil Shale: A cavern of rubblized oil shale is produced by various known methods. One such method is by detonation of a powerful explosive within an oil shale deposit. Typically, this is a nuclear explosive. Other methods are known for production of a cavern of fragmented oil shale, such as mining tunnels in the lower portion of a shale deposit and collapsing the tunnels, by dynamite thereby causing the collapse of the roof of the oil shale to facilitate production of a cavern of rubblized oil shale. This is disclosed in U.S Pat. No. 3,434,757 to Pratts. The method of forming the cavern used forms no part of the present invention.

As shown in FIG. I, the formed cavern or chimney 10 has an inner portion of rubblized shale located within an oil shale formation 11. The cavern includes a rubblized shale portion 12 and a void 13, near the top of the cavern. A zone of permeability 17 within and around the fragmented oil shale formation is formed surrounding the cavern 10.

Preferably, the rubble within the cavern will be characterized by a substantially uniform particle size of substantially less than 6". This will facilitate the advancement of the combustion zone through the rubblized shale.

An injection well 16 is provided for injecting retorting fluid into the cavern. The injection well preferred in the present invention can be provided by known drilling techniques. The injection well is drilled preferably at a slant by the so-called slant hole drilling technique. Details of this drilling technique, which involves a drilling rig, are not included here as drilling tehcniques are known and have been employed in conjunction with conventional petroleum producing methods.

It is also possible to provide one or more injection well holes that extend downwardly from the surface in a generally vertical direction with radially diverting bore hole extensions extending into the cavern and across the cavern in a generally horizontal direction. The so-called direction drilling technique can be employed to provide the deviating bore hole extension. Since direction drilling is also a well known and established technique that has been employed in conventional operations, further details of the manner in which the drilling is accomplished are not included herein.

In order to provide means for injecting the retorting fluid generally across the width of the cavern, perforated liner extensions may be employed in portion 19 of the injection well passing through the cavern. Alternately, plane liner extensions may be employed and perforations may be made after the liner has been placed. Techniques for perforating the liner after it has been positioned in the formation are well known in the art and form no part of the present invention.

Th location of the injection well is critical in the present invention. The injection well must lead to the lower portion of the chimney so that the retorting fluids are injected through perforations in the liner 16. The injected fluid will then enter the lower portion 18 of the chimney.

Catalyst Chracteristics: Extraction of oil from the oil shale cavern is started by first introducing a fine, particulate material into void 13. A second well 14 is drilled from above the cavern into the void space above the cavern. The particulate material is admitted into the voild through this well. Preferably, the void will be substantially filled with this particulate material.

The particulate material comprises microspheres having a preferred size distribution of from about 40 to about 110 microns, preferably 50 to about 90, more preferably 30 to about 110. The microspheres are formed from particles which may be non-cracking particles, oxygenated particles, equilibrium catalyst particles from a petroleum processing operation, or zeolite containing catalyst. Where particles having catalytic activity are used, the particles may or may not have combustion aids. Cracking catalysts having combustion aids are, however, the preferred catalysts.

In preferred embodiments the catalyst can be about 1/16 to ⅛ inches in diameter and can have mocroactivity of less than about 40.

Injection of the Retorting Fluid: Injection of the retorting fluid into the cavern space may be accomplished through one or more injection wells. Each well, of course, preferably will have a horizontally extending portion in the cavern. While one such injection well will provide a series of injection ports across the width of the cavern, it may be desirable to employ two or more of such injection wells in order to more fully cover the cross sectional area of the cavern. From about two to about six injection wells would normally be sufficient for this purpose although additional injection wells could be employed. Coverage across and around the cross sectional area of the cavern can conveniently be achieved by positioning four injection wells at intervals of about 45° around the circumference of the cavern.

The retorting fluid injected through the perforations supports a hot zone. The hot zone is formed across the width of the cavern by conventional ignition or burning at the injection points, i.e., at the perforations along the generally horizontally extending portion of the injection well in the cavern. While the temperature required in a hot zone in order to support combustion varies with the pressure of the cavern space, a temperature of at least about 316° C. (600° F.) preferably 427° C. (800° F.), more preferably 538° C. (1000° F.), is ordinarily required at atmospheric pressure. Hot zone temperatures between about 371° C. (700° F.) and about 1371° C. (2500° F.) may conveniently be employed.

The amount of retorting fluid employed in the practice of the present invention is not critical and may vary depending upon a number of factors, such as the retorting temperature employed, the desired extent of oil recovery, the initial shale temperature, and the like. Injection of from 20 to about 5000 standard cubic feet, preferably 40 to about 2000, more preferably 50 to about 1000 of retorting gas per cubic foot of crumbled shale in the cavern will permit the establishment of a combustion zone.

Shale Oil Recovery: The oil shale in the cavern is preheated by circulating hot air or another combustion supporting gas through the rubble. An in situ combustion is initiated and supported by a similar circulation of combustion supporting fluids. Displaced and/or combustion produced-fluids contain the oil being outflowed from the rubble.

After the hot zone has been established, it is advanced upwardly through the chimney by continuous or intermittent injection of gas that advances the heat front through the chimney. Air or another oxygen-containing gas may be conveniently employed for this purpose. The oxygen content and rate of flow of the gas together with the amount of residual combustion in the formation will determine the temperature and the rate at which the hot zone progresses through the cavern.

As burning begins, the particulate material injected into the void at the top of the cavern will tend to advance downwardly throughout the void space of the entire cavern, as the combustion zone advances upwardly. These relative motions will continue until a fluidized bed of microspheres forms, completely filling the cavern. This fluidized bed of microspheres provides an even pressure drop across the combustion zone, thereby facilitating the uniform advancement of the combustion zone up the cavern. The fluidized bed also provides a better method of distributing heat throughout the retort.

As this heating continues, the liquid exuded from the shale in the combustion zone pass upwardly through the fluidized bed of microspheres and are collected from a collection well. This retorting process causes a conversion of the heavy liquid oil to lower molecular weight, more useful products.

EXAMPLE

In a preferred embodiment, the microspheres, as discussed above, are formed from a cracking catalyst. In order to initiate cracking, the combustion zone must be about 482° to 649° C. (900° to 1200° F.), preferably 496° to 593° C. (925° to 1100° F.), more preferably 504° to 579° C. (940° to 1075° F.). The cracking converts the higher boiling oil, which would normally flow downwardly past the combustion zone, to lower boiling products. The cracking catalyst causes these hydrocarbons to form more volatile highly valued hydrocarbons, which advance up through the fluidized bed of cracking catalysts to be collected by the collection well.

There are several advantages encountered by the use of a cracking catalyst in this manner. Typically, catalysts used in retorting operations tend to become deactivated by the buildup of carbon. However, due to the fact that a fluidized bed of catalysts is created, the catalyst will tend to be activated above the combustion zone where they will initiate cracking. As these catalysts are deactivated, they tend to fall downwardly into the combustion zone where they are heated, the carbon is burned off, and the catalyst reactivated. The cracking catalyst also initiates burning of contaminants such as sulfur, nitrogen, and arsenic. Thus, the formed oil is relatively more processed than oil formed by prior art retorts.

Preferably, the recovery well may include a cyclone separator (not shown) which provides a method of separating the particulate material from the recovered shale oil. Such cyclone recovery methods are well known to those of ordinary skill in the art. The recovered catalyst can be passed back into the void in the oil shale cavern or can be retained and reused in a separate retort.

After the combustion zone has reached the top of the cavern, the combustion is complete and the burning will discontinue. The catalyst is then allowed to pass downwardly through the oil shale where it is collected at the injection wells. This can be accomplished by passing gas, preferably air, downwardly through the recovery well through the cavern and pulling this air out through the injection well.

What is claimed is:

1. A process for recovering shale oil from a subterranean cavern which contains a mass of fracture-permeated oil shale, wherein said cavern includes an internal void, comprising the steps of:

(a) introducing a fine, particulate material into the top of said void so as to completely fill said void;

(b) introducing an oxygen-containing gas into a lower portion of said cavern;

(c) initiating and maintaining combustion of said oil shale at the lower portion of said cavern;

(d) providing means for removing lower boiling heated shale oil from an upper portion of said cavern while said combustion is occurring; and (e) whereby deactivated catalyst falls downwardly into the combustion zone where it is heated, the carbon is burned off and the catalyst is reacivated.

2. A process according to claim 1 wherein said cracking catalyst comprises particles from about 30 to 110 microns in size.

3. The process of claim 2 wherein said cracking catalyst comprises an equilibrium catalyst from a petroleum processing operation.

4. The process of claim 2 wherein said cracking catalyst consists of a pelleted or microspherical cracking catalyst of from about 1/16 to about ⅛ inch in diameter.

5. The process of claim 2 wherein said catalyst has a diameter in the range of 30–110 microns.

6. The process of claim 2 wherein said cracking catalyst has a microactivity of $<40$.

7. The process of claim 1 wherein said fine, particulate material comprises a cracking catalyst also containing an oxidizing promoter.

8. A process according to claim 1, wherein said fine particulate matter is withdrawn from the retort at the end of operation, and transferred to the next retort for further utilization.

9. The process of claim 1 wherein said fine particulate matter is a zeolite containing catalyst.

* * * * *